United States Patent [19]

Crone, Jr. et al.

[11] 4,319,991

[45] Mar. 16, 1982

[54] MATERIAL SEPARATING MACHINE

[75] Inventors: William J. Crone, Jr., Beach City, Ohio; John P. Wright, Houston, Tex.

[73] Assignee: Midwestern Industries, Inc., Massillon, Ohio

[21] Appl. No.: 200,413

[22] Filed: Oct. 24, 1980

[51] Int. Cl.[3] ..... B07B 1/55

[52] U.S. Cl. ..... 209/255; 209/311; 209/380

[58] Field of Search ..... 209/234, 255, 311, 314, 209/324, 332, 380

[56] References Cited

U.S. PATENT DOCUMENTS

| | | | |
|---|---|---|---|
| 584,126 | 6/1897 | Bittinger | 209/234 |
| 3,158,568 | 11/1964 | Holman | 209/332 X |
| 3,504,793 | 4/1970 | Eaton et al. | 209/255 |
| 3,511,373 | 5/1970 | McKibben et al. | 209/380 X |
| 3,737,035 | 6/1973 | Allan | 209/380 |
| 4,116,288 | 9/1978 | Love | 175/72 X |

*Primary Examiner*—William A. Cuchlinski, Jr.

[57] ABSTRACT

Apparatus for separating a composite of three materials into their particular groups includes a first screen (17) which permits the group of the smallest sized material to pass therethrough. The materials not passing through the screen (17) are fed to a trough (21). Second screens (23) are provided near the end of the trough which permits the group of the mid-sized materials to pass therethrough. The group of the largest sized materials move to and through a discharge spout (25) at the end of the trough (21).

7 Claims, 3 Drawing Figures

MATERIAL SEPARATING MACHINE

TECHNICAL FIELD

This invention relates to an apparatus for separating a composite material into a plurality of groups according to the screen size through which the groups will pass. More particularly, this invention, according to a specific use thereof, can separate the valuable well drilling fluid and lost circulation material from the undesirable particulate material created by the well drilling process.

BACKGROUND ART

Most often when one wishes to separate a composite material into a plurality of discrete groups, classified by size, the composite material is passed through a plurality of stacked screens of increasingly finer mesh so that the group of material of the largest size is separated first and successively smaller sized groups separated thereafter. This system of separation has some practical problems and is not suited for all applications. For example, because the screens are stacked, it is only useful where there is a great deal of vertical space available. Additionally, because the screens with the more delicate finer mesh are positioned underneath the more durable heavier mesh screens, an imperfection or tear in the finer screens, which more readily occurs, is not easily discernable. Further, the process time required for the material to travel over and through the plurality of screens through many steps renders many processes time consuming and inefficient.

These types of systems also prove undesirable for specific applications. For example, in the oil well drilling industry a drilling fluid, sometimes known as drilling mud, is continuously injected into the well at the drilling location. This fluid not only cleans and lubricates the bit but it also serves as a medium to, by hydraulic pressure, bring the undesirable drilling earthen material, such as sand, crushed shale and the like, to the surface. In some, more simple operations, the undesirable material is then separated from the drilling fluid and the cleaned drilling fluid circulated back into the well.

Oftentimes the formations being drilled will have small fissures or cracks therein. In such instances the drilling fluid can and does flow into these cracks to the expense and detriment of the continuous system. To avoid losses of drilling fluid a process has been developed whereby an additional material, termed lost circulation material, is added to the drilling fluid. This material, which can generally be any fiberous material, then fills or clogs the crevices in the earth and prevents any substantial losses of drilling fluid. Typical of the lost circulation material used are such items as walnut shells, cellophane, sawdust chips or the like.

The addition of the lost circulation material compounds the separating problems because it, like the drilling fluid, is preferably cleaned and recirculated. Thus exiting the well is the drilling fluid of small size, the lost circulation material of a large size, and the undesirable material of a size therebetween, with the largest and smallest of the materials to be recirculated. One proposed solution to this separation problem is nothing more than a conventional two step screening process as shown in U.S. Pat. No. 4,116,288. There the exiting mixture of drilling fluid, lost circulation material and undesirable material is first subjected to a coarse screening to separate the lost circulation material from the drilling fluid and undesirable material which drops to a second finer screen therebelow to separate the drilling fluid from the undesirable material. The drilling fluid and lost circulation material are then reunited for recirculation into the well.

Not only is this system susceptible to the height restrictions and obscure fine screen problem previously described but it also is a slow two step process and even at that, inefficient. Quite often the moist, fiberous lost circulation material will be coated with undesirable material which will not go through the first screen and which is therefore circulated back into the well. In short, no prior art separating equipment is efficiently able to cope with problems such as created by the specific application just described.

DISCLOSURE OF THE INVENTION

It is thus a primary object of the present invention to provide a material separating device which separates the smallest sized material from the larger sized materials first.

It is an important object of the present invention to provide a material separating device, as above, which finds application in the well drilling industry in the separation of drilling fluid, lost circulation material and undesirable material.

It is another object of the present invention to provide a material separating device, as above, which can remove substantially all the undesirable material from the drilling process by washing it off the lost circulation material.

It is an additional object of the present invention to provide a material separating device, as above, which can separate at least three groups of materials in a single step thereby providing a quick and efficient separation while saving space and enabling the operator to maintain a clear view of the screening process.

These and other objects of the present invention, which will become apparent from the description to follow, are accomplished by the means hereinafter described and claimed.

In general, a device for separating a composite material into three groups classified according to the screen size through which the particular group will pass includes a screen through which the grouping of the smallest sized material will pass. The materials which do not pass through the screen fall into a trough at the periphery of the screen and move toward a discharge spout at the end of the trough. At least one additional screen is provided in the trough near the discharge spout which allows the grouping of the mid-sized material to pass therethrough while retaining the grouping of the largest sized material thereon for subsequent discharge through the spout.

PREFERRED EMBODIMENT FOR CARRYING OUT THE INVENTION

Figure 1:
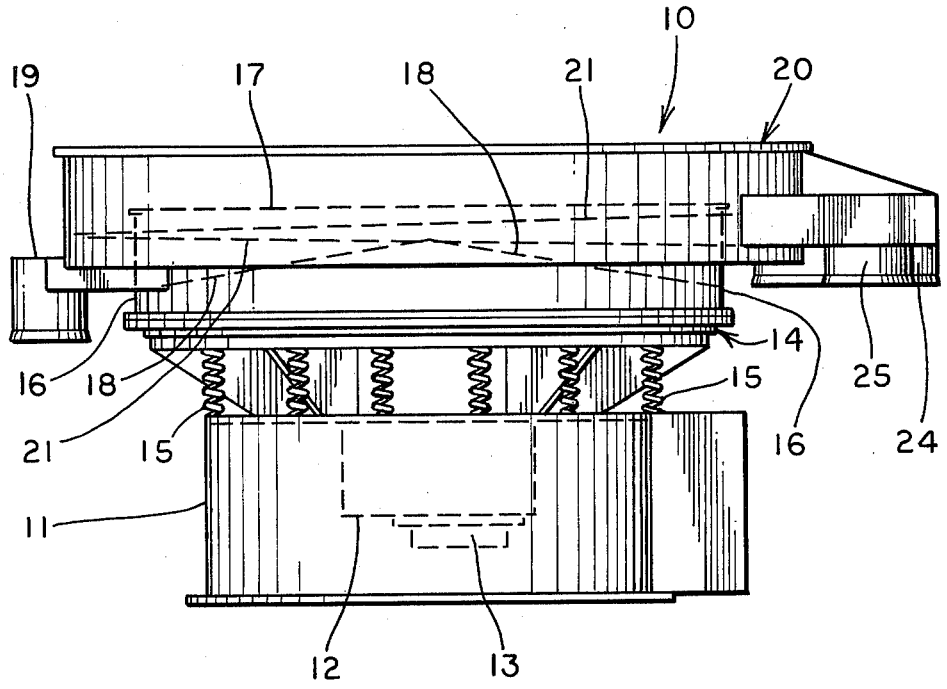
FIG. 1 is a somewhat schematic elevational view of the material separating device according to the concept of the present invention.

A material separator according to the present invention is indicated generally by the numeral 10 in FIG. 1 and includes a base member 11 which houses a motor 12 that can be of the type having eccentric weights 13 to provide the material separator with an oscillating or vibrating motion. A table frame, generally indicated by the numeral 14, is supported by a plurality of springs 15 and thus freely oscillates when motor 12 is in operation. Table frame 14 includes an annular or cylindrical side member 16 which carries, at the top thereof, a screen 17 mounted in a conventional manner. As will hereinafter be more fully discussed, according to the present invention screen 17 should be of a relatively fine mesh so that only the smallest sized group of material will pass therethrough. Positioned within cylindrical member 16 and beneath screen 17 is a domed portion 18 onto which material falls during the separation process. Material passing through screen 17 is discharged through spout 19.

Figure 2:
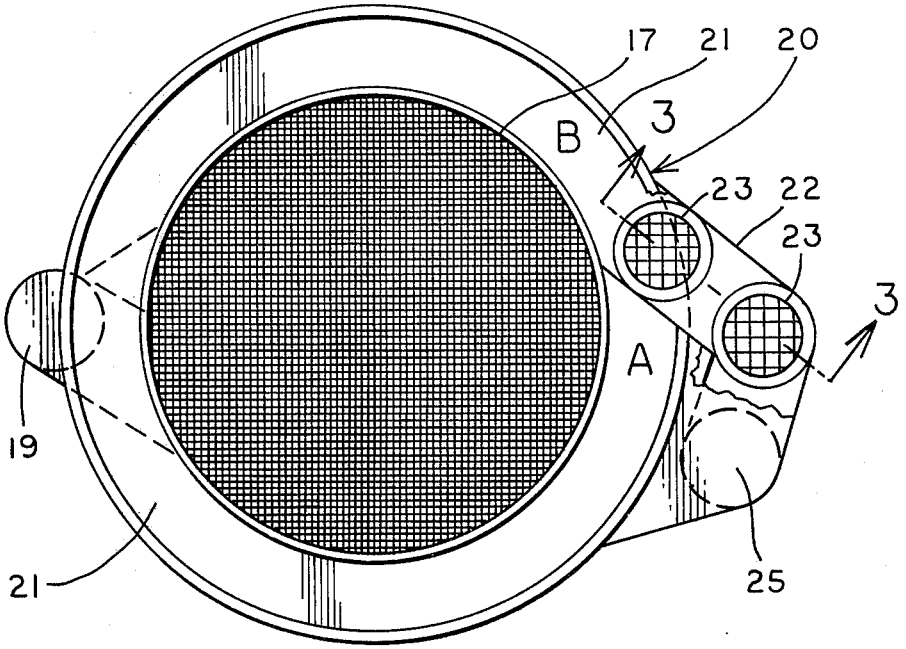
FIG. 2 is a top plan view of the material separating device shown in FIG. 1.

Mounted to surround screen 17 is a frame member, generally indicated by the numeral 20, which, as best shown in FIG. 2, forms a trough 21 around the periphery of screen 17. In its preferred form and as shown by the dotted lines in FIG. 1, trough 21 gets progressively deeper in a spiral-like fashion beginning at point A in FIG. 2 just below the level of screen 17 and ending at point B substantially lower. In the preferred form, trough 21 becomes approximately one inch deeper over each ninety degree span thereof. Such a configuration moves the material faster and consequently permits the material separator to handle more material per unit of time.

Near the end of trough 21 at approximately point B, a trough extension 22 is formed and carries two screens 23 flush at the bottom thereof. While two screens are shown as preferred, a different number could be utilized without departing from the spirit of this invention. As will hereinafter be more fully discussed, according to the present invention screens 23 should be of a larger mesh than screen 17. Material which passes through screens 23 is discharged through a spout 24 and material which does not pass therethrough is discharged through a spout 25 positioned at the end of trough extension 22.

Figure 3:
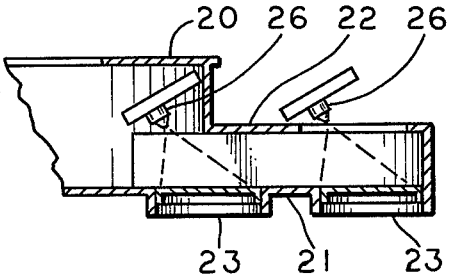
FIG. 3 is a partial sectional view taken substantially along line 3—3 of FIG. 2.

Depending on the type of materials being separated it may at times be helpful to aid the separation at screens 23 by utilizing liquid jets. Thus, as shown in FIG. 3, nozzles 26 may be conveniently mounted above screens 23 to provide jets of water to actually flush material through screens 23 and otherwise wash the material not passing through screens 23.

The operation of material separator 10 will be described with reference to a specific application therefor, namely, operation relative to the well drilling industry, although the device has applicability to numerous other separating processes. As previously described, during well drilling separation of a composite material which includes drilling fluid, lost circulation material, and undesirable material is required. In such a process, the drilling fluid and lost circulation material are kept and recirculated while the undesirable material is discarded. The composite material is fed to the top of screen 17, which is a fine mesh, in this instance a screen on the order of 80 to 325 mesh. With motor 12 in operation all structures above springs 15 will oscillate or vibrate and the drilling fluid, the smallest sized of the materials, will pass through screen 17 and out chute 19 from where it can be conveyed back to the well head. The lost circulation material and undesirable material remaining on screen 17 are conveyed generally radially outwardly by the vibrating motion and will drop into trough 21. The vibrating motion causes the lost circulation material and undesirable material to travel in the trough with further separation taking place at screens 23, which are of a heavier mesh, in this instance on the order of a 10 to 30 mesh. The smaller undesirable material will pass through screens 23 and chute 24 and be discarded with the larger fiberous lost circulation material continuing through chute 25 from where it can be conveyed back to the well head for mixing with the now clean drilling fluid and subsequent reconveyance into the well bore. Because the undesirable material may well adhere to the lost circulation material, nozzles 26 provide the fluid spray to wash the lost circulation material and flush the undesirable material through screens 23.

It should thus be evident that a material separating device constructed and operated in accordance with the invention herein substantially improves the art, in particular the art as it relates to the separation of materials in the well drilling process, and otherwise accomplishes the objects of the present invention.

We claim:

1. Apparatus for separating a composite material into three groups classified according to the screen size through which the groups will pass comprising first screen means receiving the composite material and allowing the grouping of the smallest sized material to pass therethrough, a trough at the periphery of said first screen means to receive the groupings of the largest and mid-sized of the materials, a discharge spout at the end of said trough, second screen means in said trough near said discharge spout, said second screen means being of a different mesh than said first screen means, and nozzle means above said second screen means to emit a spray of fluid material to wash the grouping of the mid-sized material through said second screen means with the grouping of the largest sized material moving through said discharge spout.

2. Apparatus according to claim 1 wherein said trough is sloped with its lowest point being at the end thereof having said discharge spout.

3. Apparatus according to claim 1 further comprising discharge means below said first screen means to discharge the grouping of the smallest sized material.

4. Apparatus according to claim 3 further comprising second discharge means below said second screen means to discharge the grouping of the mid-sized material.

5. Apparatus according to claim 1 wherein said second screen means includes a plurality of screens mounted flush in the bottom of said trough.

6. Apparatus according to claim 5 wherein said nozzle means includes a spray nozzle mounted above each of said screens to emit a jet of fluid onto each of said screens.

7. Apparatus for first separating drilling fluid from a mixture of drilling fluid, lost circulation material and undesirable material and then separating the undesirable material from the lost circulation material comprising, first screen means receiving the mixture of drilling fluid, lost circulation material and undesirable material and segregating therefrom the drilling fluid, means to discharge the drilling fluid, trough means receiving the lost circulation material and undesirable material, second screen means of a different mesh than said first screen means and approximate the end of said trough means to separate the undesirable material from the lost circulation material, and nozzle means to emit a fluid spray and wash the undesirable material from the lost circulation material and through said second screen means.

* * * * *